US005310364A

United States Patent [19]

Hooper et al.

[11] Patent Number: 5,310,364

[45] Date of Patent: May 10, 1994

[54] GROUNDING BLOCK

[75] Inventors: Frederick D. Hooper; James D. Anderson, both of Norwalk, Conn.

[73] Assignee: Burndy Corporation, Norwalk, Conn.

[21] Appl. No.: 971,053

[22] Filed: Nov. 3, 1992

[51] Int. Cl.[5] ..... H01R 11/09

[52] U.S. Cl. ..... 439/724; 439/206; 439/736

[58] Field of Search ..... 439/723, 724, 283, 685, 439/695, 696, 707, 708, 936, 465, 467, 721, 736

[56] References Cited

U.S. PATENT DOCUMENTS

| | | | |
|---|---|---|---|
| Re. 28,710 | 2/1976 | Finkelstein | 339/97 L |
| 2,892,173 | 6/1959 | Brereton | 339/94 |
| 3,125,706 | 3/1964 | Long | 439/723 |
| 3,182,278 | 5/1965 | Bridle | 339/59 |
| 3,383,643 | 5/1968 | Nava et al. | 339/205 |
| 3,397,384 | 8/1968 | Lawrence | 339/258 |
| 3,456,231 | 7/1969 | Paullus et al. | 439/716 |
| 3,471,822 | 10/1969 | Van Baelen | 339/18 |
| 3,725,852 | 4/1973 | Blanchet | 439/724 |
| 3,755,615 | 8/1973 | Paullus et al. | 174/76 |
| 3,877,772 | 4/1975 | De Cenzo | 339/74 R |
| 3,970,352 | 7/1976 | Dorrell et al. | 339/59 M |
| 4,138,187 | 2/1979 | Brygger | 339/117 R |
| 4,220,385 | 9/1980 | Luca, Jr. et al. | 339/59 M |
| 4,356,344 | 10/1982 | Carey | 174/52 S |
| 4,531,796 | 7/1985 | Gansert et al. | 339/60 M |
| 4,568,133 | 2/1986 | Amano et al. | 339/14 R |
| 4,580,863 | 4/1986 | Lohr et al. | 339/94 M |
| 4,585,285 | 4/1986 | Martens | 339/17 LC |
| 4,602,830 | 7/1986 | Lockard | 339/14 R |
| 4,655,518 | 4/1987 | Johnson et al. | 339/17 LC |
| 4,655,525 | 4/1987 | Hunt, III et al. | 339/63 M |
| 4,725,242 | 2/1988 | Sonobe et al. | 439/279 |
| 4,767,346 | 8/1988 | Giebel et al. | 439/95 |
| 4,871,321 | 10/1989 | Johnson | 439/79 |
| 4,880,388 | 11/1989 | Beamenderfer et al. | 439/108 |
| 5,040,998 | 8/1991 | Suzuki et al. | 439/79 |
| 5,064,390 | 11/1991 | Umesato et al. | 439/721 |
| 5,102,353 | 4/1992 | Brunker et al. | 439/608 |
| 5,104,329 | 4/1992 | Brown et al. | 439/108 |
| 5,112,251 | 5/1992 | Cesar | 439/607 |
| 5,160,282 | 11/1992 | Swaffield et al. | 439/724 |
| 5,192,233 | 3/1993 | Suffredini et al. | 439/936 |

OTHER PUBLICATIONS

IBM, Mechanical Strain Relief on a Surface-Mounted Connector, 1987, vol. 29, No. 8, p. 3631.

*Primary Examiner*—Gary F. Paumen
*Assistant Examiner*—Hien D. Vu
*Attorney, Agent, or Firm*—Perman & Green

[57] ABSTRACT

A grounding block electrical connector is provided with a housing, electrical contact terminals, a housing insert, retainer clips, and a top cap. The housing is a one-piece metal member with a receiving cavity, top rivet posts, bottom rivet posts, and drainage holes. The contact terminals have contacts located in the receiving cavity and an integral busing strip. The busing strip is electrically and mechanically connected to the housing by the bottom rivet posts. The housing insert is located in the receiving cavity and has holes with the contacts located in the holes. The top cap is fixedly connected to the top of the housing over the receiving cavity by the top rivet posts. The housing insert has posts extending from its top surfaces that are located in post apertures of the top cap to thereby hold the insert at a stationary position in the receiving cavity.

15 Claims, 2 Drawing Sheets

GROUNDING BLOCK

BACKGROUND OF THE INVENTION

1. Field of the Invention

The present invention relates to electrical connectors and, more particularly, to a grounding block electrical connector.

2. Prior Art

U.S. Pat. No. 3,471,822 to Van Baelen discloses a terminal junction system for electrical conductors with a connector that has a housing, a contact strip, a retainer, a seating insert, and a cover plate. U.S. Pat. No. 3,397,384 to Lawrence discloses an electrical terminal held together by rivets and having a bus bar. U.S. Pat. No. 4,138,187 to Brygger discloses vent holes on a flexible section. U.S. Pat. No. 4,880,388 to Beamenderfer et al. discloses signal contacts joined to a ground bus and rivets formed integral with a housing block used to project through pilot holes in the ground bus. U.S. Pat. No. 4,602,830 to Lockard discloses an electrical connector with an insulator block positioned in an overmolded housing and a forward housing member. U.S. Pat. No. 3,725,852 to Blanchet discloses an electrical connector with an inner cap, an outer cap, and a cover. U.S. Pat. No. 28,710 to Finkelstein discloses a molded socket for an electrical harness. The following U.S. Pat. Nos. are also cited for general interest: 5,104,329; 4,767,346; 4,871,321; 5,040,998; 5,102,353; 5,112,251; 4,568,133; 4,585,285; 4,531,796; 4,655,518; 2,892,173; 3,182,278; 4,220,385; 4,356,344 and 4,725,242.

SUMMARY OF THE INVENTION

In accordance with one embodiment of the present invention, a grounding block is provided comprising a housing, an electrical contact terminal, a housing insert, and a top cap. The housing has a receiving cavity, top rivet posts, and bottom rivet posts. The electrical contact terminal has a busing strip and contacts extending from the busing strip. The contacts are located in the receiving cavity of the housing. The busing strip is located adjacent a bottom of the housing and is connected to the housing by the bottom rivet posts. The housing insert is located in the receiving cavity of the housing and has a plurality of holes with the contacts located therein. The top cap is connected to the housing over the receiving cavity and is connected to the housing by the top rivet posts.

In accordance with another embodiment of the present invention, an electrical connector housing insert is provided. The insert is comprised of a one piece molded dielectric material and includes a bottom section, a top section, and posts extending from a top surface. The bottom section has a plurality of contact receiving areas. The top section has a plurality of open areas and ledges located between the contact receiving areas and the top surface of the insert.

In accordance with another embodiment of the present invention, a grounding block is provided comprising a housing, an electrical contact terminal, a housing insert, and a top cap. The housing has a receiving cavity and drainage holes extending from the receiving cavity to an exterior of the housing. The electrical contact terminal is fixedly connected to the housing with contacts located in the receiving cavity. The housing insert is located in the receiving cavity and is comprised of a one piece molded polymer member. The housing insert has the contacts located in holes in the insert and has posts extending from a top surface. The top cap is fixedly connected to the housing at an entrance to the receiving cavity and has the insert posts located in post apertures in the top cap such that the top cap can stationarily hold the insert at a predetermined position in the housing.

In accordance with one method of the present invention, a method of manufacturing a grounding block is provided comprising steps of providing an electrically conductive housing having a contact receiving cavity; inserting a contact spacer insert into the contact receiving cavity; inserting rows of contacts into the contact receiving cavity and into holes in the spacer; and connecting the rows of contacts to the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
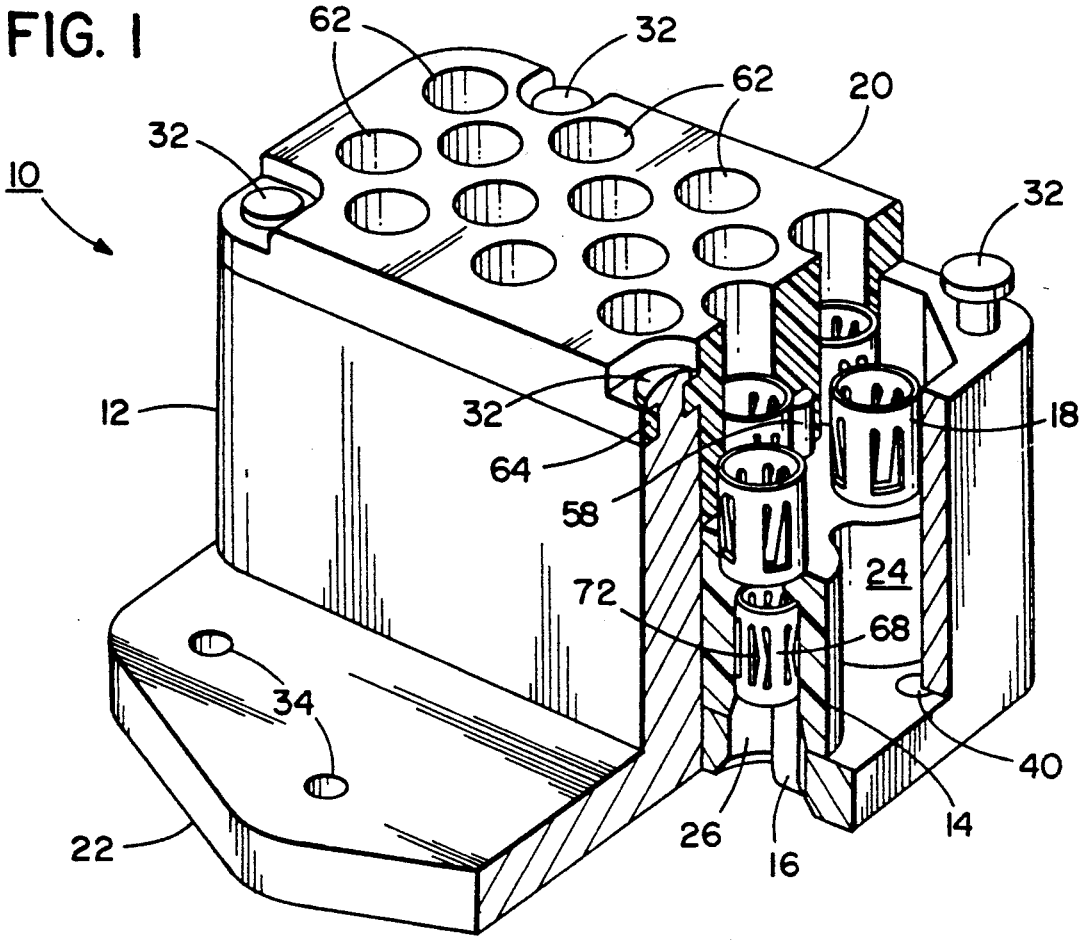
FIG. 1 is a perspective view with a cut away section of a grounding block incorporating features of the present invention.
Figure 2:
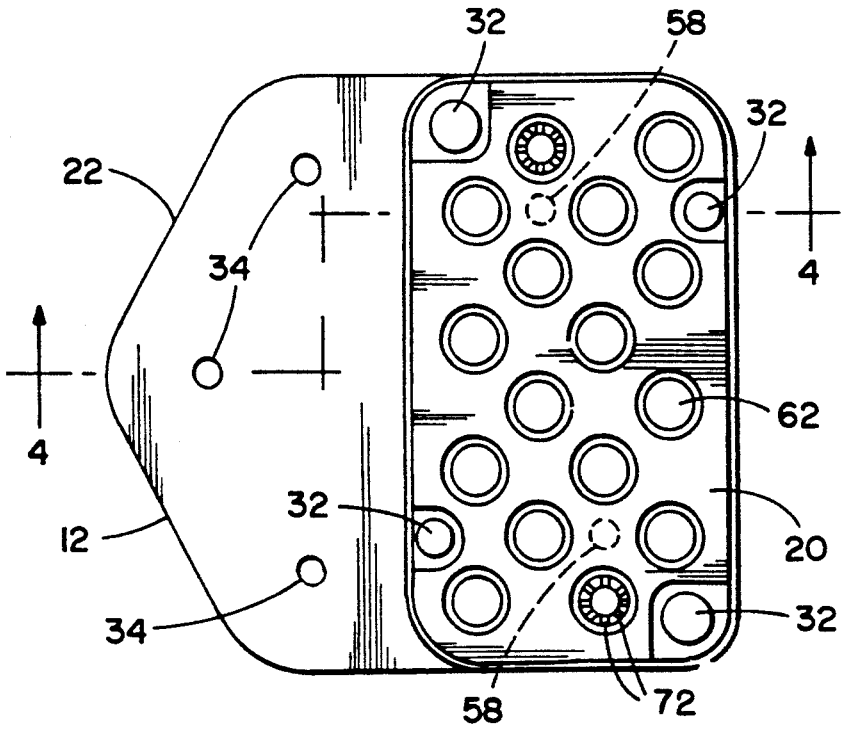
FIG. 2 is a top plan view of the grounding block shown in FIG. 1.
Figure 3:
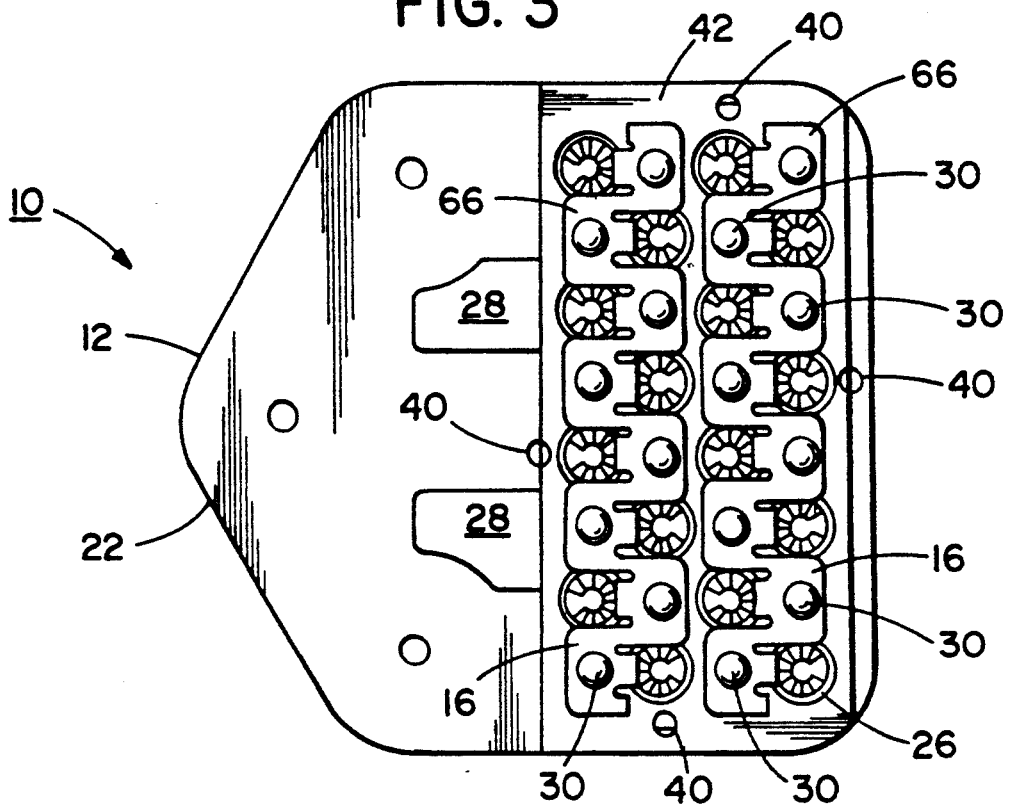
FIG. 3 is a bottom plan view of the grounding block shown in FIG. 1.
Figure 4:
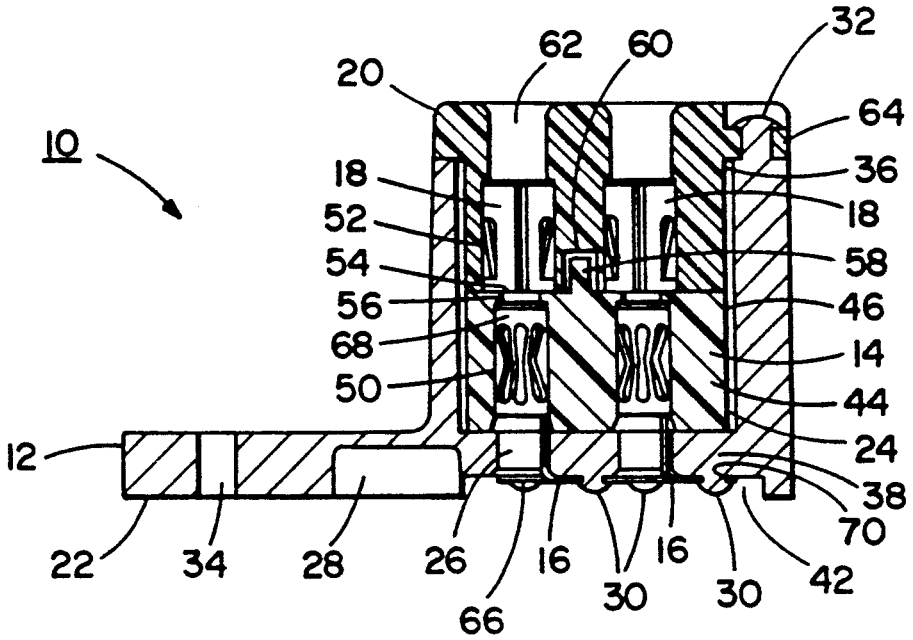
FIG. 4 is a cross sectional view of the grounding block shown in FIG. 2 taken along line 2—2.

Referring to FIGS. 1–4, there is shown a grounding block 10 incorporating features of the present invention. Although the present invention will be described with reference to the single embodiment shown in the drawings, it should be understood that the present invention may be embodied in various different forms of embodiment. In addition, any suitable size, shape or type of numbers or materials could be used.

The grounding block 10 is generally intended for use on an aircraft to ground electrical wires to the frame of the aircraft. However, the block 10 could be used in any suitable environment. A similar grounding block is disclosed in copending U.S. Pat. application No. 07/817,713, filed Jan. 7, 1992, now U.S. Pat. No. 5,192,233 issued Mar. 9, 1993, entitled "Grounding Block" by Suffredini et al. and assigned to the same assignee as herein which is hereby incorporated by reference. In addition to being used in a grounding block, features of the present invention could also be used in a terminal or junction block (i.e.: a connector used to connect conductors to each other; not necessarily to a ground).

The grounding block 10 generally comprises a housing 12, a housing insert 14, two contact terminals 16, retainer clips 18, and a top cap 20. The housing 12 is generally comprised of electrically conductive material, such as die cast aluminum. The housing has a mounting base 22, a receiving cavity 24, contact access apertures 26, relief areas 28, bottom rivet posts 30 and top rivet posts 32. The mounting base 22 has holes 34 for mounting the block 10 to the frame of an aircraft by use of suitable fasteners (not shown). However, any suitable mounting system could be provided. Alternatively, the housing 12 need not have means for mounting it to another member, such as if the block 10 is used as a junction block rather than a grounding block. The relief areas 28 are provided to reduce the weight of the block 10, but need not be provided. The receiving cavity 24 extends into the housing 12 at a top aperture or entrance 36 that is covered over by the top cap 20. In the embodiment shown, the housing has four integral top rivet posts 32 that extend from the top surface of the housing 12 around the receiving cavity 24 proximate its four corners. However, any suitable number of top rivet posts could be provided in any suitable configuration. The housing 12 has a bottom section 38 at the base of the receiving cavity 24. The bottom section 38 has the contact access apertures 26 extending therethrough. In the embodiment shown, sixteen apertures 26 are provided; one for each contact of the terminals 16. However, any suitable number of access apertures could be provided. In the embodiment shown, the bottom section 38 also includes four drainage holes 40 extending through the bottom section 38 from the receiving cavity 24 to the exterior of the housing 12. The drainage holes 40 are located on the four sides of the receiving cavity 24 in order to insure that fluid, such as condensation that collects in cavity 24, can exit the cavity 24 through one of the drainage holes 40 regardless of the block's mounted orientation on the aircraft frame. However, the drawings holes need not be provided, or any suitable number could be provided in any suitable configuration. Extending from the bottom surface of the bottom section 38 are sixteen integrally formed bottom rivet posts 30. However, any suitable number could be provided. In the embodiment shown, the access apertures 26 and bottom rivet posts 30 are arranged in a four alternating row configuration as seen best in FIG. 3. However, any suitable type of configuration could be provided. The housing 12 also has a recessed area 42 under the bottom section 38.

The housing insert or contact spacer 14 is preferably made from a molded polymer or plastic material. In the embodiment shown, the insert 14 is a one-piece member. However, in alternate embodiments, the insert can be comprised of a plurality of members. The insert 14 generally comprises a bottom section 44 and a top section 46. In the embodiment shown, the insert 14 has four rows of offset holes that form contact receiving areas 50 and top section open areas 54. The bottom section 44 has sixteen contact receiving areas 50; one for each of the contacts on the terminals 16. The bottom section also has tapered apertures at the bottom of the insert at entrances to the contact receiving areas 50 to assist in inserting the contacts 68 of the terminals 16 into the insert 14. The top section 46 has sixteen open areas 54 and inwardly extending ledges 56 located between the aligned contact receiving areas 50 and the top surface of the insert 14. The ledges 56 function to form restricted passages between retainer clip receiving areas in the top cap 20 and the contact receiving areas 50 to limit the maximum size of a male contact (not shown) that can be inserted into the contacts 68 of the terminals 16 so that the contacts 68 will not be damaged by an oversized male contact. The top surface of the insert 14 also has two integral posts 58. These posts 58 are received in post holes 60 in the top cap 20. The insert 14 is stationarily positioned in the receiving cavity 24 sandwiched between the top surface of the housing bottom section 38 and the bottom surface of the top cap 20. Because the top cap 20 is fixedly and stationarily connected to the housing 12, as further described below, and the post 58 are contained in the cap post holes 60, the insert 14 is held in its stationary position with a space between the exterior side walls of the insert 14 and the interior side walls of the housing 12 in the receiving cavity 24. This space is provided for proper drainage and access to the drainage holes 40. The insert 14 could, of course, be made of any suitable type of material. However, a molded plastic or polymer material is preferred because it is lightweight, inexpensive, and can be manufactured with very close tolerances thereby reducing vibrations.

The top cap 20 is preferably made of a lightweight material, such as a polymer or plastic material. However, any suitable material could be used. The cap 20 is generally provided with retainer clip receiving areas 52, the post holes 60, male contact passages 62, and rivet mounting holes 64. The post holes 60 extend into the bottom surface of the cap 20 and make a substantially tight fit with the posts 58 to prevent the insert 14 from moving relative to the cap 20. This prevents vibrations that otherwise might occur in the aircraft environment. In the embodiment shown, the top cap 20 has sixteen retainer clip receiving areas 52 to hold the retainer clips 18. The cap 20 has inwardly extending ledges at the top of the retainer clip receiving areas 52 to retain the clips 18 against the top surface of the insert 14. The areas 52 are aligned with the areas 50 when the insert 14 and cap 20 are connected to each other (posts 58 in post holes 60). There are sixteen male contact passages 62; one for each of the pairs of contacts 68 and retainer clips 18. However, any suitable number of passages could be provided. The passages 62 allow male contacts to be inserted into the retainer clips 18 and contacts 68 of the terminals 16. Four rivet mounting holes 64 are provided in the cap 20; one for each of the housing top rivet posts 32. The posts 32 extend up through the holes 64 and are deformed to form rivet heads to fixedly and stationarily hold the cap 20 on the top of the housing 12.

The retainer clips 18 are generally similar to those found in the prior art. In the embodiment shown, the bottom of the clips 18 are allowed to rest on the top surface of the insert 14. The clips 18 are larger than the cap passages 62. Therefore, the clips 18 are effectively locked at the clip receiving areas 52. The clips 18 are obviously positioned in the areas 52 prior to the top cap 20 being attached to the housing 12. The cap 20 is attached only after the insert 14 is first positioned in the cavity 24.

The terminals 16, in the embodiment shown, are provided as two multi-contact terminals that are electrically and mechanically connected to the housing 12. The two terminals 16 are identical, however, any suitable number or type of terminals could be provided including multiple single contact terminals or one multiple contact terminal. Each terminal 16 is comprised of a sheet of metal that is cut and preformed, such as by stamping, to form a busing strip 66 and eight socket contacts 68. The busing strip 66 has eight holes 70 for eight of the housing bottom rivet posts 30 to extend through. The posts 30 are then deformed to form rivet heads to fixedly and stationarily mount the terminals 16 to the bottom of the housing 12 in the recessed area 42. The socket contacts 68 extend in alternating fashion on opposite sides of the busing strip 66 in two rows. Each contact 68 in the embodiment shown, has eight spring contact legs 72 to receive a portion of a male contact therebetween. The contacts 68 are positioned through the access apertures 26 in the housing bottom section 38 and into the contact receiving areas 50 of the housing insert 14. When the bottom rivet posts 30 are deformed, the contact between the posts 30, the busing strip 66, and the bottom face of the housing 12, electrically and mechanically connects the socket contacts 68 to the housing 12.

An alternate embodiment of the present invention could include the insert having the clip receiving areas 52. In such an embodiment the top cap 20 would not have clip receiving areas and need not extend into the receiving cavity 24. The bottom surface of the cap 20 would then form a blocking surface to retain the clips 18 in the insert clip receiving areas.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A grounding block comprising:

a housing having a receiving cavity, top rivet posts extending from a top surface of the housing, and bottom rivet posts extending from a bottom surface of the housing;

an electrical contact terminal having a busing strip and contacts extending from the busing strip, the contacts being located in the receiving cavity, the busing strip being located adjacent a bottom of the housing and being connected to the housing by the bottom rivet posts;

a housing insert located in the receiving cavity, the insert having a plurality of holes with the contacts located therein; and a top cap connected to the housing over the receiving cavity, the top cap being connected to the housing by the top rivet posts.

2. A grounding block as in claim 1 wherein the housing also comprises drainage holes extending from the receiving cavity to an exterior of the housing.

3. A grounding block as in claim 1 wherein the housing is comprised of a one-piece metal member and has a mounting shelf extending from the bottom of the housing for mounting the housing to another member.

4. A grounding block as in claim 1 wherein the bottom rivet posts extend from the bottom of the housing and through holes in the busing strip and are deformed to form rivet heads to hold the busing strip against the housing bottom.

5. A grounding block as in claim 1 wherein the insert is comprised of a one-piece molded plastic member and the holes each have a bottom contact section and a top support ledge above the bottom contact section.

6. A grounding block as in claim 1 wherein the insert has posts extending from a top surface of the insert.

7. A grounding block as in claim 6 wherein the top cap has post holes with the insert posts located therein such that the top cap can hold the insert at a stationary position in the receiving cavity.

8. A grounding block as in claim 1 wherein the housing has the top rivet posts located in rivet holes of the top cap, the top rivet posts being deformed to form rivet heads to hold the top cap against the housing.

9. A grounding block comprising:

a housing having a receiving cavity and drainage holes extending from the receiving cavity to an exterior of the housing;

an electrical contact terminal fixedly connected to the housing with contacts located in the receiving cavity;

a housing insert located in the receiving cavity, the insert being comprised of a one-piece molded polymer member and having the contacts located in holes in the insert, the insert having posts extending from a top surface; and a top cap fixedly connected to the housing at an entrance to the receiving cavity and having the insert posts located in post apertures of the top cap, the housing including integral top rivet posts extending from a top surface of the housing and the top cap having rivet holes with the top rivet posts extending through the rivet holes and fixedly connecting the top cap to the housing.

10. A grounding block as in claim 9 wherein the housing has integral bottom rivet posts extending from a bottom surface of the housing.

11. A grounding block as in claim 10 wherein the contact terminal has its contacts extending from an integral busing strip, the busing strip being located adjacent the housing bottom surface with the bottom rivet posts extending through holes in the busing strip and fixedly connecting the busing strip to the housing.

12. A grounding block as in claim 9 further comprising retainer clips located in the top cap, the insert having ledges located between the contacts and retainer clips.

13. A grounding block as in claim 9 wherein the housing is comprised of a one-piece metal member with a mounting base adapted to mount the housing to another member.

14. A grounding block as in claim 9 wherein the grounding block has at least two contact terminals and the terminals extend up into the receiving cavity through holes in a bottom surface of the housing.

15. A method of manufacturing a grounding block comprising steps of:

providing an electrically conductive housing having a contact receiving cavity;

inserting a contact spacer insert into the contact receiving cavity, the contact spacer insert having a plurality of individual holes for receiving individual contacts;

inserting rows of contacts into the contact receiving cavity and into the holes in the spacer;

electrically and mechanically attaching the rows of contacts to the housing;

connecting a cap to a top of the housing; and wherein the step of connecting a cap comprises inserting integral rivet posts of the housing into rivet holes of the cap and deforming the rivet posts to fixedly attach the cap to the housing.

* * * * *